US005695300A

United States Patent [19]

Echols et al.

[11] Patent Number: 5,695,300

[45] Date of Patent: Dec. 9, 1997

[54] ADJUSTABLE RECOVERY BOOM AND SYSTEM

[75] Inventors: James F. Echols, Bellaire; Marvin Echols, deceased, late of Henderson, both of Tex., by Ruth H. Echols, legal representative

[73] Assignee: BetzDearborn Inc., Trevose, Pa.

[21] Appl. No.: 504,276

[22] Filed: Jul. 19, 1995

Related U.S. Application Data

[63] Continuation-in-part of Ser. No. 27,811, Mar. 8, 1993, abandoned.

[51] Int. Cl.[6] ..... E02B 15/04

[52] U.S. Cl. ..... 405/63; 405/60

[58] Field of Search ..... 405/60, 63–72

[56] References Cited

U.S. PATENT DOCUMENTS

| | | | |
|---|---|---|---|
| 3,592,005 | 7/1971 | Greenwood | 405/71 |
| 3,641,770 | 2/1972 | Fitzgerald | 405/67 |
| 3,731,491 | 5/1973 | Markel et al. | 405/67 |
| 3,740,955 | 6/1973 | Fossberg | 405/67 |
| 3,802,201 | 4/1974 | Hoult et al. | 405/72 X |
| 3,859,797 | 1/1975 | Ayers | 405/72 |
| 3,973,406 | 8/1976 | Casey | 405/66 |
| 4,319,858 | 3/1982 | Jaffrennou et al. | 405/68 |
| 4,330,223 | 5/1982 | Webb | 405/63 |
| 4,430,955 | 2/1984 | Jaffrennou et al. | 405/63 X |
| 5,110,236 | 5/1992 | Santamaria | 405/63 |

*Primary Examiner*—Tamara L. Graysay
*Assistant Examiner*—Frederick L. Lagman
*Attorney, Agent, or Firm*—Alexander D. Ricci; Steven D. Boyd

[57] ABSTRACT

A boom system having a flexible barrier is supported by floats on offset arms. The offset arms and floats thereon are mounted to the barrier in a manner which allows the angle between the barrier and the offset arms to be easily varied. The orientation of the barrier with respect to the surface the boom system is disposed on can thus be easily varied to account for variations in wind, waves and currents. Furthermore, the orientation of the barrier is controlled without the use of ballast weights.

4 Claims, 5 Drawing Sheets

FIG.1
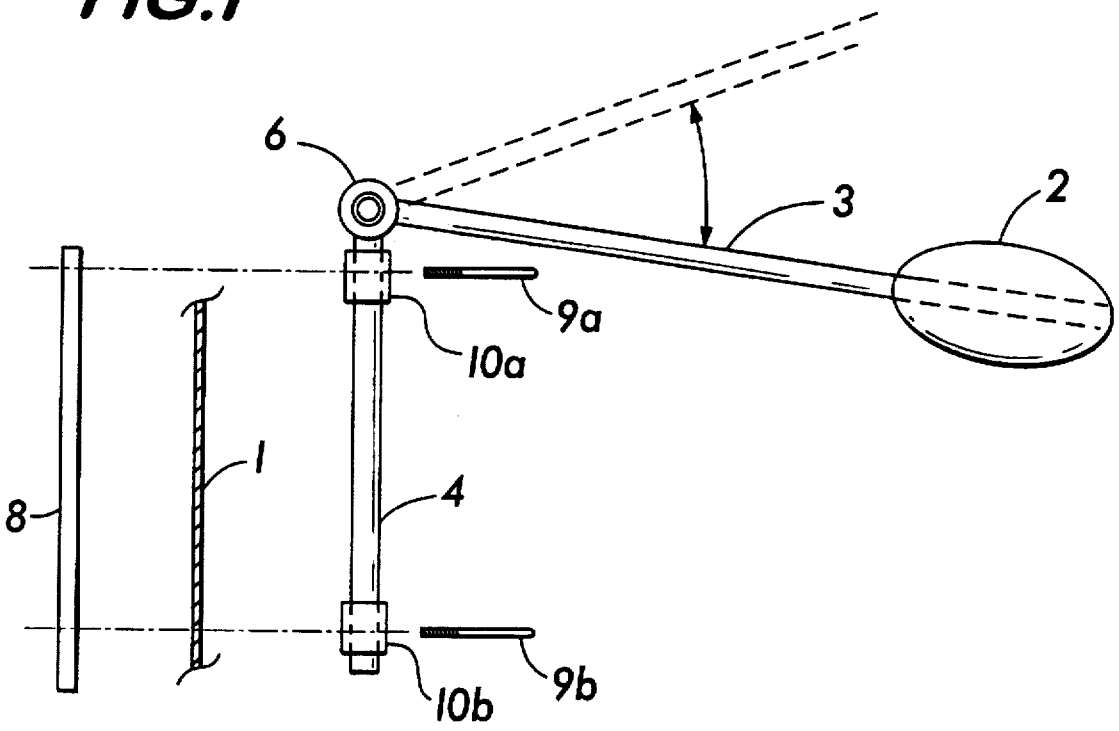
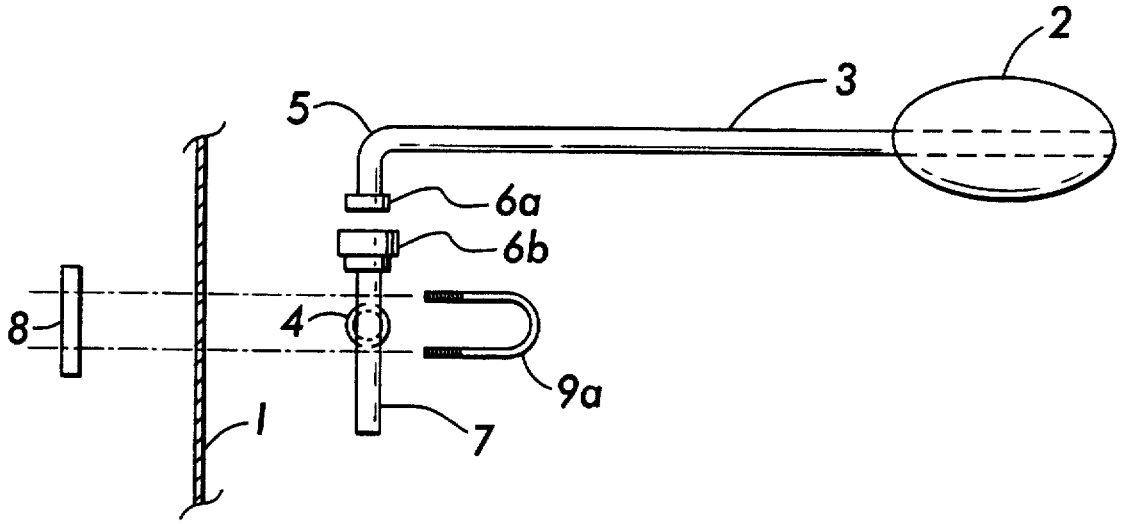
FIG.2

ADJUSTABLE RECOVERY BOOM AND SYSTEM

This application is a continuation-in-part of application Ser. No. 08/027,811 filed Mar. 8, 1993, now abandoned.

FIELD OF THE INVENTION

The present invention relates to novel means for intercepting surface flow and aiding the recovery of fluids thereon or of discrete articles on or near such surfaces. When used in connection with the recovery of articles such as cleaners for tubes of heat exchangers, it will afford significant energy savings in power generation and other fields.

BACKGROUND OF THE INVENTION

With the increasing incidence of large oil spills on the oceans and lakes of commerce, it has become common for rapid reaction facilities to stock containment or interception booms of various designs. Such booms typically comprise a more-or-less rugged, somewhat flexible barrier, typically of a tough plastic material of some sort, which is intended to float vertically when disposed in a body of water. The tops of such barriers are supported above the surface of the water for a short distance by a series of flotation devices dispersed at intervals along the length of the boom, which may be hundreds or even thousands of feet in length. Such booms are intended to be maintained vertical by a series of ballast weights dispersed at intervals along the bottom portion thereof. The addition of such ballast weights—which are necessary in prior art designs—increases the number of flotation devices required, and thus increases the cost of such booms, in addition to the cost of the ballast weights themselves. Further, while many such boom designs are adequate for ideal conditions—no wind, waves or currents—few if any boom designs known to the prior art can handle adequately the real world conditions of variable winds, waves and complex surface currents. In practice, then, a common failing of prior boom designs is their tendency to be deflected from the vertical by the smallest of current flows, for intercepted current flows simply to submerge below the barrier, and for such barriers to be rendered ineffective by only moderate wave action. Wave action of greater than a modest amount will permit surface fluids and tube cleaners to be carried over the tops of such barriers, a failing which becomes even more pronounced as the barriers are displaced more from the vertical by wind or current flow.

Many invasive systems exist to recover recirculating elastomeric spheres used to clean the tubes of heat exchangers and the like. Most such systems have a large grate or bar screen of some kind mounted to intercept the discharge flow and deflect the cleaning balls to some sort of recovery means, or a traveling screen which likewise intercepts the flow and positively removes the cleaning spheres. All such grates or screens must necessarily be of finer mesh than the spheres being utilized to clean the tubes, and therefore cause a considerable increase in the back pressure of the discharge flow, which results in a concomitant loss of energy efficiency. It has long been realized that considerable energy savings could be obtained with a non-invasive recovery system, i.e., a system which would perform all such recovery in an open conduit with essentially no back pressure, provided that a system could be devised that would operate under open water conditions both reliably and cost effectively. That is to say, prior art boom designs failed to perform their capture or interception function efficiently enough to permit such non-invasive recovery systems to be economically possible. Thus both the art and applicants have experienced a long-felt and unsatisfied need for a truly effective interception/recovery boom design. Those experienced in the field are aware that multiples of tens of thousands of such cleaning elements are typically utilized in the cleaning of the huge banks of tubes of heat exchangers, and that such cleaning elements are recycled, either in batches or continuously, many times per day. Thus those experienced in the field realize that even a very small escape rate quickly results in the loss of such a large number of cleaning elements as to render such non-invasive cleaning systems unfeasible from an economic standpoint. Those in the spillage containment field likewise have first-hand familiarity with the amount of crude oil which escapes over or under existing barrier systems, but nevertheless continue to employ such systems simply because, at least up until now, there has been no better alternative.

SUMMARY OF THE INVENTION

It is therefore an object of the present invention to provide a boom design which will permit the interception and recovery of surface fluids and of surface or near-surface objects under considerably more adverse conditions of wind, wave and currents than heretofore permitted by the prior art.

It is a further object of the present invention to provide a boom design which will not cause the formation of vortex or other turbulent flows of such a magnitude as to permit the escape of surface fluids or objects beneath the barrier of such boom designs.

It is a still further object of the present invention to provide a boom design which will permit the angle with respect to vertical of the intercepting barrier to be easily varied to counter adverse conditions of wind, wave and currents.

It is a more specific object of the present invention to provide a boom design which will permit the angle with respect to vertical of the intercepting barrier to be easily varied in order to maintain a desired angle with respect to the incident current flow, and furthermore, a design which will permit such angle to be easily varied, even while the boom is in the water, from time to time as operating circumstances may change.

It is still another object of the present invention to provide a boom design in which the freeboard barrier height above the water surface may be readily adjusted.

It is yet a further object of the present invention to provide a boom design which will permit the intercepting barrier to be angled inwardly against current flow at both the top and bottom portions of the barrier, and which may be angled in different directions as well as amounts over different sections of such boom.

It is yet another object of the present invention to provide a boom design which will not only perform significantly better than conventional booms but be significantly cheaper to manufacture as well.

It is a still more specific object of the present invention to eliminate the necessity for, and the expense of, the series of ballast weights typically required by conventional designs.

Briefly stated, in accordance with the present invention there is preferably provided an intercepting barrier without ballast weights which is supported by a series of offset flotation devices and tensioning cable(s). The offset flotation devices may all be mounted on one side, primarily on one side, or in approximately equal numbers on each side of the barrier. Additionally, the offset flotation members are mounted in such a way as to permit the angle with respect to the barrier to be rapidly changed as the circumstances of use may change, such as with seasonal changes of prevailing wind direction and the like. Thus, with the flotation devices floating on a surface, the angle of the barrier with respect to the surface can be rapidly changed. In many applications—for example, when intercepting strong surface flows, or when wave action is significant—it may be preferable to orient the intercepting barrier at an acute angle in order to decrease radically the submerging flow beneath the barrier. By "submerging flow" is meant that particular type of flow which tends to transport surface fluids or articles beneath an intercepting barrier. In other applications, it may be preferred to orient the barrier at one angle or direction over one portion of the barrier and at a different angle or direction over another section, or to angle both top and bottom portions of the barrier inwardly against the current flow. In still other applications, it may be desired to increase the proportion of the barrier height which projects above the surface level, the free-board height. The present invention will permit such height to be changed rapidly and while the boom is deployed in the water; i.e., the apparatus need not be returned to land to make such adjustments. Thus, its intercepting function need not be interrupted to effect such changes. Freeboard barrier height and barrier angle may be changed simply by rotating the float-supporting arms with respect to the barrier.

When used as a recovery system for physical articles such as recirculating elastomeric spheres or more sophisticated tube cleaners, the present system will allow virtually uninterrupted flow or transport of such articles along the smooth upstream surface of the barrier to a convenient recovery location, with virtually no loss through either submerging flow or over-the-top wave action. When used in the recovery of "state-of-the-art" tube cleaners having a specific gravity within about 10% of water, the smooth upstream side of the present boom was found to minimize submerging flow or over-the-top flow. Since the number of such tube cleaners typically utilized in cleaning the tube banks of the typical power generating station is so large—literally in the multiples of tens of thousands per installation—and since such cleaners are typically recirculated thousands of times in just a very few days, it is readily seen how even a very small fractional loss of such cleaners per cycle quickly renders such a recovery system economically prohibitive. The present system offers such a radical improvement in recovery as to virtually eliminate such losses, practically speaking.

BRIEF DESCRIPTION OF THE DRAWINGS

FIG. 1 is a mechanical schematic of a preferred offset flotation arrangement along with an exploded view of one means for attaching the same to an intercepting barrier shown in cross section, FIG. 1 is essentially an end view.

FIG. 2 is a top view of the arrangement depicted in FIG. 1.

DETAILED DESCRIPTION OF THE PREFERRED EMBODIMENTS

Figure 3A:
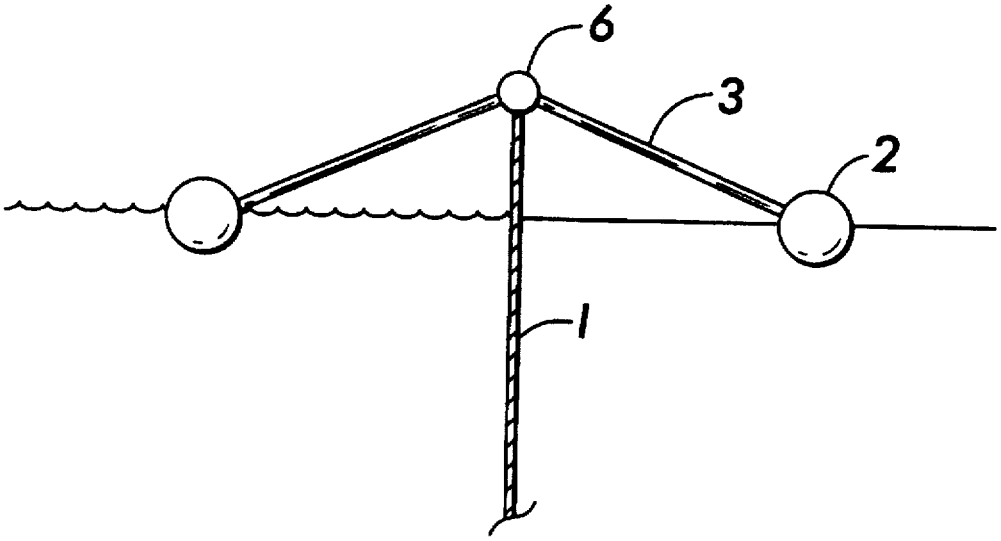
FIGS. 3*a* and 3*b* are essentially end views of one arrangement for readily adjusting the freeboard height of the barrier of the present invention.

FIG. 1 is a mechanical schematic of a single offset float arrangement preferred for the present invention along with an exploded view of one means for attaching the same to the intercepting barrier. The barrier 1 is shown in cross section.

Flotation device 2 may be any convenient flotation device; the type of floats commonly used to support ropes in swimming pools has been found fully satisfactory. The various rigid members may be of any convenient manufacture; common Schedule 40 polyvinylchloride pipe, of nominal ¾ inch inside diameter, had been found adequate in all tests to date. In addition, if sealed, the submerged portions of such members will further add buoyancy to the overall support of the system, As may be seen in FIG. 1, mounting arm 3, which may also be of such PVC tubing, is secured at one end to flotation device 2 and movably secured at the other end to a support or stabilizer 4. FIG. 2 is a top view of the arrangement depicted in FIG. 1, and the movably securing arrangement may be better understood by referring to FIG. 2. There, it is readily seen how one end of arm 3 is connected to an elbow 5 which in turn is connected to one part of a union piece 6*a*. When union piece 6*a* is inserted into receiving union piece 6*b*, which will resist but not prevent rotation, it is readily seen that the angle which float 2 and arm 3 make with stabilizer 4 may be readily changed simply by pushing up or down on float 2 or arm 3 with sufficient force to overcome the resistance provided by union 6. As is also best illustrated by FIG. 2, receiving union piece 6*b* is preferably attached to a "Tee" member 7 which in turn is attached to stabilizer 4. In lieu of tee 7, a simple ell may be substituted. However, if it be desired to have offset floats on both sides of any one stabilizer 4, then a tee or something similar thereto, functionally, would be preferred.

Figure 7:
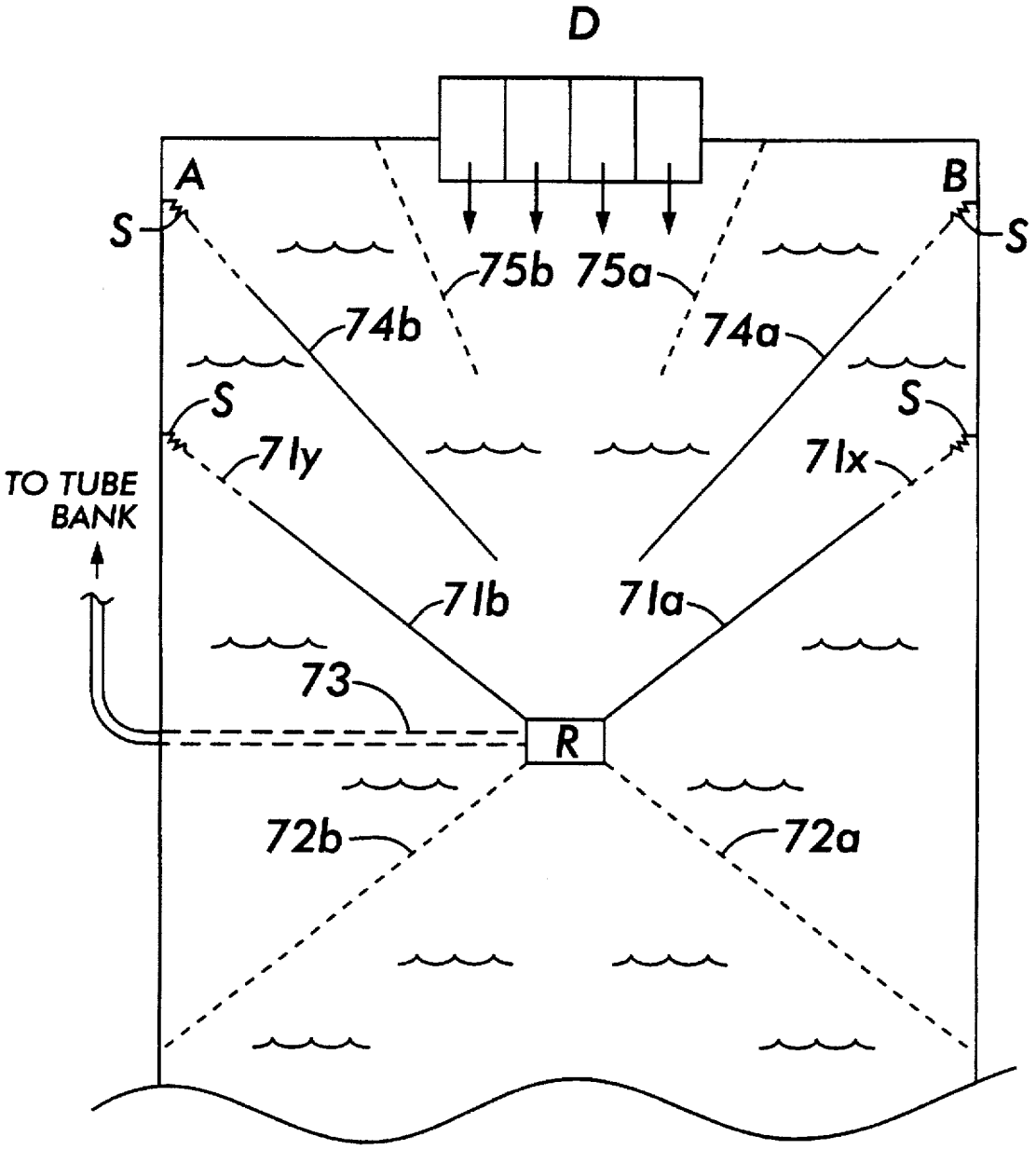
FIG. 7 depicts a plan view of a preferred arrangement for deploying the present boom system so as to recovery tube cleaners.

Offset floats may be oriented on one or both sides of stabilizer 4, that is the downstream or both the upstream and downstream sides, see FIG. 3. The offset floats may alternate, upstream and downstream, on alternating stabilizers, or each stabilizer may have a pair of offset floats or any combination of pairs and alternating offset floats. The offset floats provide orienting support for the boom without the need for ballast weights. Orientation of the boom in a water system is accomplished through a combination of anchor means such as tensioning cables (72*a*, 72*b*, 71*x*, 71*y* in FIG. 7) and the offset floats. The use of anchor means such as tensioning cables to orient booms is well known in the art. For long duration use, the PVC should be replaced by environmentally resistant material.

The apparatus comprising float, arm, union, connecting pieces and stabilizers may, for applications in which a simple, straight shape (in cross section) of barrier 1 is sufficient, be connected to barrier 1 by any convenient means. This is to say, stabilizer 4 may, for such applications, be permanently attached to barrier 1, as, for example, by stapling barrier 1 to one side of stabilizer 4, by direct glue or other chemical bonding means, or by cutting slots in stabilizer 4 adequate to slide barrier 1 therethrough, etc. For testing purposes it was preferred to have a means for attachment which would permit numerous adjustments to be made, and thus the attachment scheme depicted in FIGS. 1 and 2 was developed. In this scheme, stabilizer 4 was attached to a flat stiffener 8—a common 1"×4" timber piece is adequate—on the opposite side of barrier 1 by means of a pair of U-bolts 9*a* and 9*b*. Wear elements 10*a,b* were surmounted upon stabilizer 4, but such may not be necessary for purely commercial embodiments. In actual demonstrations, four or five "outrigger" arrangements per one hundred feet of boom length have been found adequate for moderately severe conditions.

Barrier 1 may be manufactured of most any material of adequate rigidity yet flexibility, tensile strength, and resistance to sunlight and sea water. A preferred barrier, however, may be obtained from Slickbar Products Corporation of Seymour, Connecticut, and comprises a Kevlar® (a trademark of DuPont for aromatic polyamide fiber) mat coated with ultraviolet-resistant and ozone-resistant polyurethane. A polyvinyl chloride coated polyester scrim may also be employed. Cheaper materials may be utilized for many applications, such as common vinyl, for example, for barriers which may be exposed to sun and sea only infrequently, but for extended or continued use, the foregoing material is preferred. 100-foot lengths are commonly available, with connectors at each end which permit the length to be extended as much as may be desired. Since such end connections are typically metallic, and therefore heavy, a one-sided float—i.e., a float attached to one side only of the barrier—is typically attached to each end to support such end connections. Over a length of 100 feet, an additional two or three such one-sided floats may be evenly spaced along the barrier for further support.

Figure 3B:
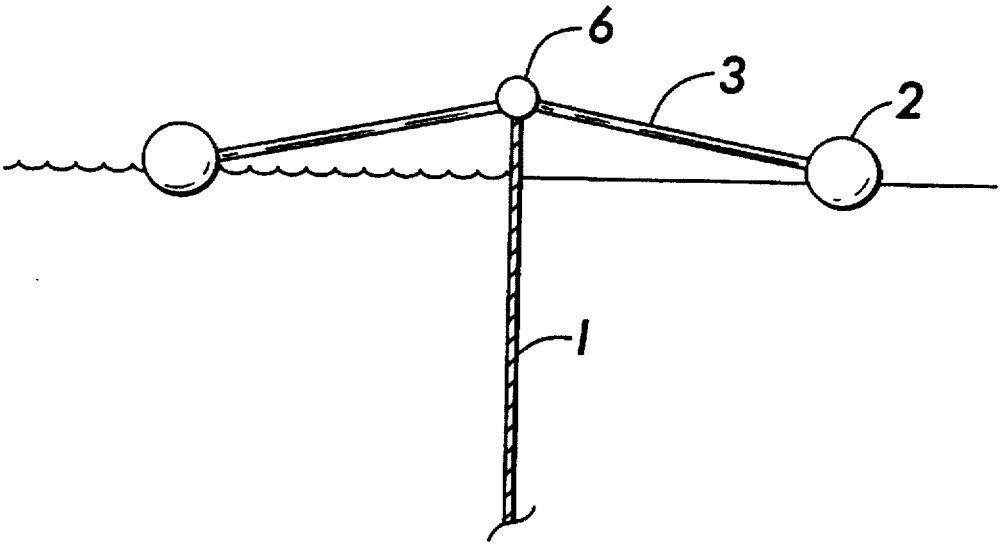

Such barriers are typically manufactured from 12 inches in depth up to 36 inches in depth, but a 14-inch depth has been found adequate for nearly all conditions tested thus far, with approximately 4 inches thereof projecting above the surface. When outrigger flotation devices are placed on each side of the barrier, the height above water may be conveniently increased simply by decreasing the angles between such flotation devices and the barrier, as is shown in FIGS. 3*a* and 3*b*. Or, floats 2 may be adjustable on arms 3, or such arms may be extensible.

Figure 4A:
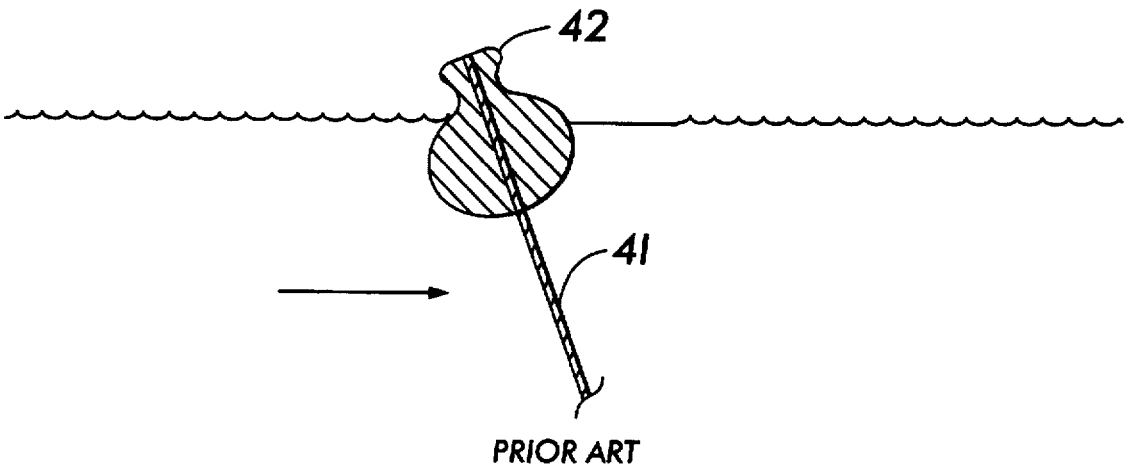
FIG. 4*a* depicts a prior art float/barrier arrangement being deflected by current.

Experience in the field has demonstrated that projections of approximately one inch—either of a flat-edged 1"×4" or of an approximately one-inch cylinder—will interfere with neither spheres or tube cleaners nor with trash, i.e., that none will accumulate at or near any such small discontinuities. Similarly, it has been found that such small discontinuities will not cause downwelling vortices or other downward turbulent flows to form, contrary to those of the typical prior art floats, as shown in FIG. 4*a*. The barrier of the present invention has been found to be particularly effective at the recovery of state-of-the-art tube cleaners used in cleaning heat exchanger tubes. Such tube cleaners have a specific gravity within about 10% of the water they "float" in. The smooth upstream side of the barrier and absence of water forming discontinuities minimizes down welling vortices. In such recovery operations as exemplified by FIG. 7, the angle of interrupt between the barrier and current is controlled, and the current flow is known allowing efficacious orientation of the barrier.

Figure 4B:
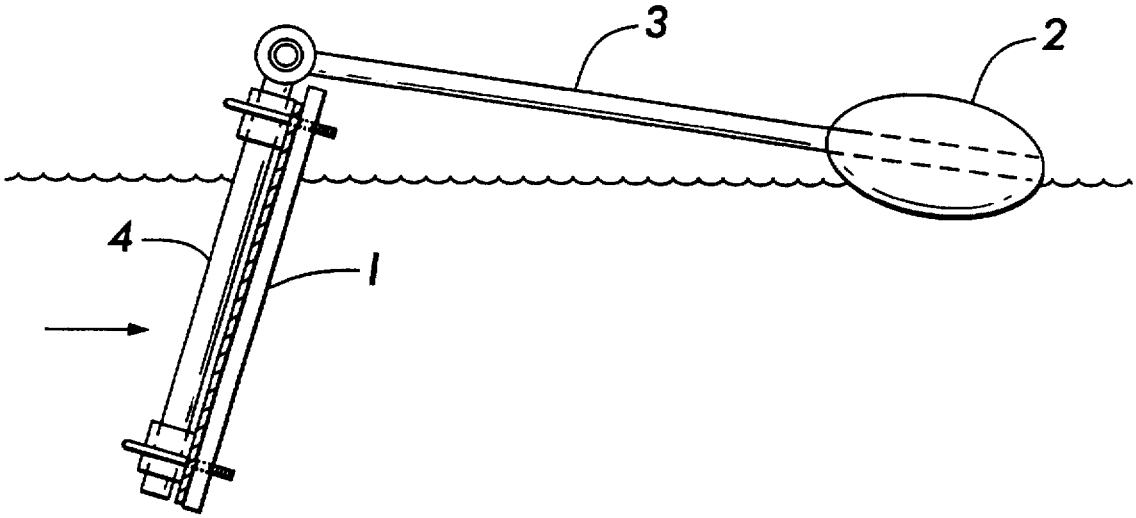
FIG. 4*b* illustrates adjustment to oppose such flow. Both are essentially end views.

FIG. 4*a* depicts a prior art float 42 in cross section surmounting a barrier 41. Those skilled in the art will appreciate that an intercepted current flow will tend to rotate the lower portion of any intercepting barrier in the direction of the current flow, thereby making it even easier for submerging flows to transport surface fluids or articles under and beyond the intercepting barrier. The prior art attempted to counter such rotation by the use of ballast weights. This latter phenomenon may be prevented in the present invention by adjusting the angles between floats 2 arms 3 and stabilizers 4 such that barrier 1 is not maintained vertically but rotated to oppose the rotation caused by the intercepted current flow. This is best illustrated by FIG. 4*b*, which shows such rotation or off-vertical adjustment of stabilizers 4 opposing the current flow, indicated by the heavy arrow therein. For a barrier of straight profile, however, there is a limit to how much the lower portion may be rotated toward the current flow (the upstream direction) to resist the submerging flow, since such rotations tend to reduce the effective height of that portion of the barrier above the surface, making it easier for fluids and articles on the surface to be carried over the top. This compromising result can to some extent be overcome by adjusting the arms to further raise the freeboard height of the barrier, but this too has its limits. Maximum intercepting efficiency under such conditions may be achieved by a complex barrier profile.

Figure 5A:
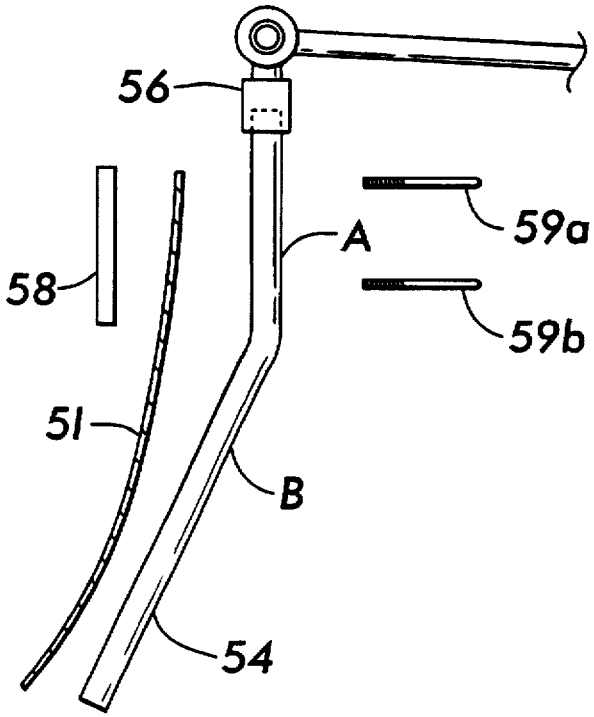
FIG. 5*a* illustrates in exploded form an alternate preferred embodiment.
Figure 5B:
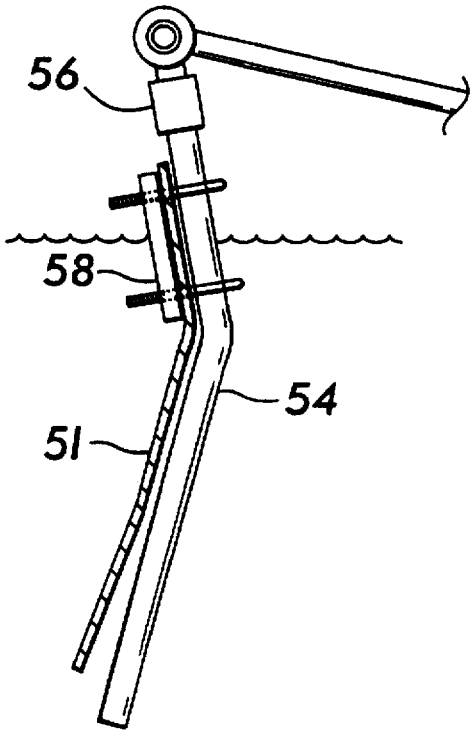
FIG. 5*b* illustrates the same in assembled form and in use.

FIG. 5 illustrates a modified arrangement which will permit a considerable variation in the orientation of the upper and lower portions of intercepting barrier 1. FIG. 5*a* illustrates the main components in exploded view for clarity; FIG. 5*b*, in assembled form and in use. In FIG. 5, the wear elements are not shown for added clarity; stabilizer 54 is shown depending from an element 56 which could be either a second union or a threaded receiver which will permit a rotation of up to 90° of stabilizer 54.

As illustrated in FIG. 5*a*, stabilizer 54 is shown as comprising a first portion A and a second portion B angled with respect to A. For convenience in installing, the stabilizer 54 of such a system may initially be oriented so as to present a flat surface to barrier 51, and then rotated to such other angle as may be desired as the barrier is paid out. Those skilled in the art should appreciate that the floats and arms of the device of FIG. 5 can be easily varied so as to cause portion A of member 54 to be tilted inward to oppose the current flow, as shown in FIG. 5*b*, thereby further increasing the effectiveness of the barrier.

Figure 6:
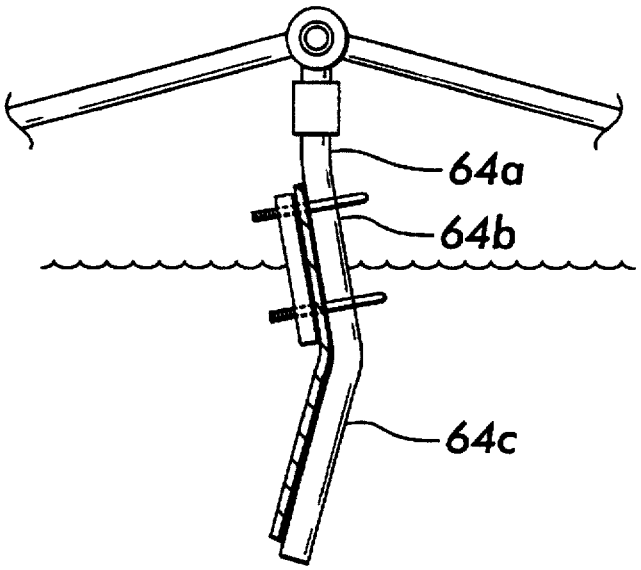
FIG. 6 illustrates an end view of still another alternate preferred embodiment.

Alternatively, for ease of providing an effectively concave barrier without having to adjust the tilt, and to provide a convenient means of raising or lowering the freeboard height of such a concave barrier without effecting tilt, an arrangement such as shown in FIG. 6 may be preferred. There, it will be noted, stabilizer 64 first depends vertically downward, at 64A, then downstream, at 64B, and then upstream, at 64C; unlike the arrangement of FIG. 5, it will usually be preferable for this type that member 64 not be rotatable, due to the complications of securing the same to the barrier, but under some circumstances it may be worthwhile so to do. An alternative material for the barrier may be conveyor belting, also available in a pre-formed "V" shape.

What is thus provided by the present invention are novel recovery booms useful in a wide variety of applications. Other means of accomplishing the objects of the present invention will suggest themselves upon a full appreciation of the teaching herein, but it should be clearly understood that such alternate means may be practiced without departing from the scope of the invention disclosed herein. It should also be clearly understood that the apparatus and techniques depicted in the foregoing drawings and explained in the foregoing description are intended only as exemplary embodiments of the present invention and not as limitations thereto.

What is claimed is:

1. In a boom system having flexible barrier means, anchoring orientation means, and a plurality of flotation members, the improvements comprising orienting an upper portion of said flexible barrier means at a first angle with respect to a lower portion of said flexible barrier means; and offset float arms supporting said plurality of flotation members mounted to said upper portion of said flexible barrier means through means for varying a second angle formed by said offset float arms and said upper portion of said flexible barrier means, said boom system free of ballast weights.

2. The boom system of claim 1 wherein said first angle is obtuse whereby said flexible barrier means forms a concave surface with respect to an intercepting current.

3. A ballast weight free boom system comprising a flexible barrier means having an upper portion oriented at a first angle with respect to a lower portion, a smooth upstream surface and a downstream surface, offset flotation arms extending from said upper portion of said flexible barrier means via means for varying a second angle between said upper portion of said flexible barrier means and said offset flotation arms.

4. The ballast weight free boom system of claim 3 wherein said first angle is obtuse whereby said smooth upstream surface forms a concave surface with respect to an intercepting current.

* * * * *